US008894255B1

(12) United States Patent
Kimball et al.

(10) Patent No.: US 8,894,255 B1
(45) Date of Patent: Nov. 25, 2014

(54) MODEL AIRPLANE ILLUMINATION SYSTEM

(71) Applicants: Roger Kimball, Reunion, FL (US); Alexander Stephens, Reunion, FL (US); Jennifer Kimball, Reunion, FL (US)

(72) Inventors: Roger Kimball, Reunion, FL (US); Alexander Stephens, Reunion, FL (US); Jennifer Kimball, Reunion, FL (US)

(73) Assignee: RK and K Marketing, Inc., Reunion, FL (US)

( * ) Notice: Subject to any disclaimer, the term of this patent is extended or adjusted under 35 U.S.C. 154(b) by 0 days.

(21) Appl. No.: 13/798,294

(22) Filed: Mar. 13, 2013

(51) Int. Cl.
*B60Q 1/00* (2006.01)

(52) U.S. Cl.
USPC ..... 362/459; 362/470

(58) Field of Classification Search
CPC ..... B47D 47/06; B64D 2011/0038
USPC ..... 362/470, 459; 244/199.4
See application file for complete search history.

(56) References Cited

U.S. PATENT DOCUMENTS

| | | | | |
|---|---|---|---|---|
| 2,881,307 | A * | 4/1959 | Adler, Jr. | 362/470 |
| 5,416,672 | A | 5/1995 | Authier | |
| 5,690,408 | A * | 11/1997 | de la Pena et al. | 362/556 |
| 5,793,164 | A * | 8/1998 | Authier | 315/300 |
| 6,600,274 | B1 | 7/2003 | Hughes | |
| 7,219,861 | B1 | 5/2007 | Barr | |
| 7,806,371 | B2 | 10/2010 | Troutman | |

* cited by examiner

*Primary Examiner* — Evan Dzierzynski
(74) *Attorney, Agent, or Firm* — McKinney Law, PLLC

(57) ABSTRACT

A model airplane illumination system is disclosed. The system includes a plurality of carbon fiber wingtip rods, a wingtip mount configured to secure at least one of the wingtip rods substantially perpendicular to each wingtip of a model airplane, and a plurality of light emitting diodes ("LED"), where at least one LED of the plurality of LEDs is secured to each end of the wingtip rods and configured to illuminate surfaces of the model airplane. In addition, the system includes a carbon fiber tail rod, a tail mount configured to secure the tail rod to a tail of the airplane and configured to illuminate the surfaces of the airplane, and at least one LED of the plurality of LEDs is secured to each end of the tail rod and configured to illuminate the tail and fuselage surfaces of the model airplane.

20 Claims, 5 Drawing Sheets

FIG. 4
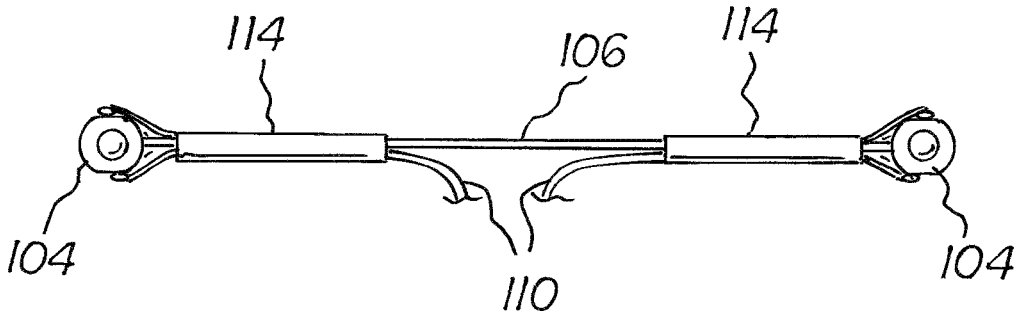
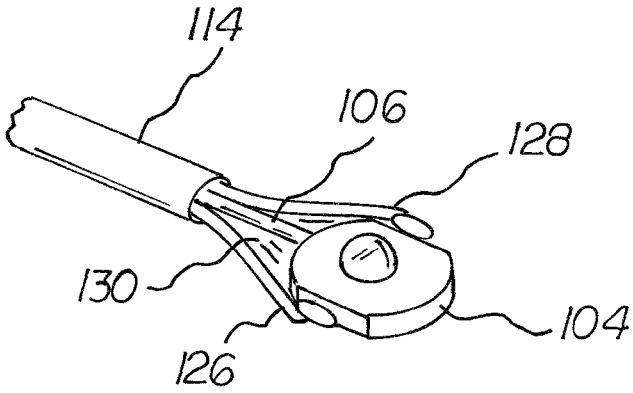
FIG. 5

FIG. 6
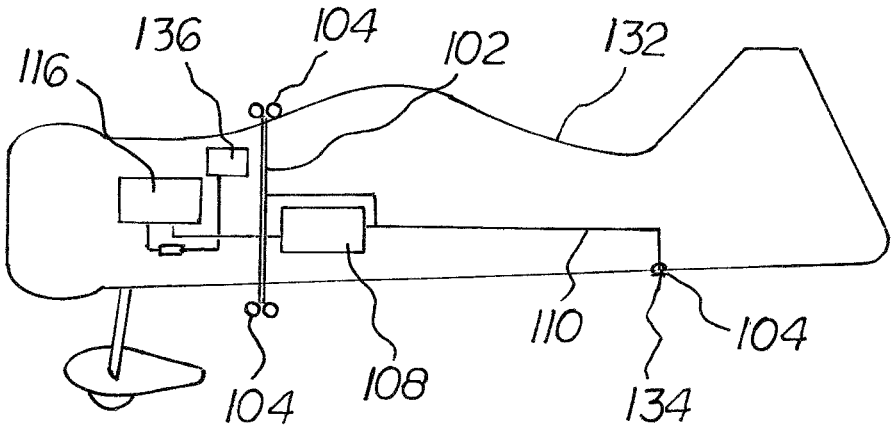
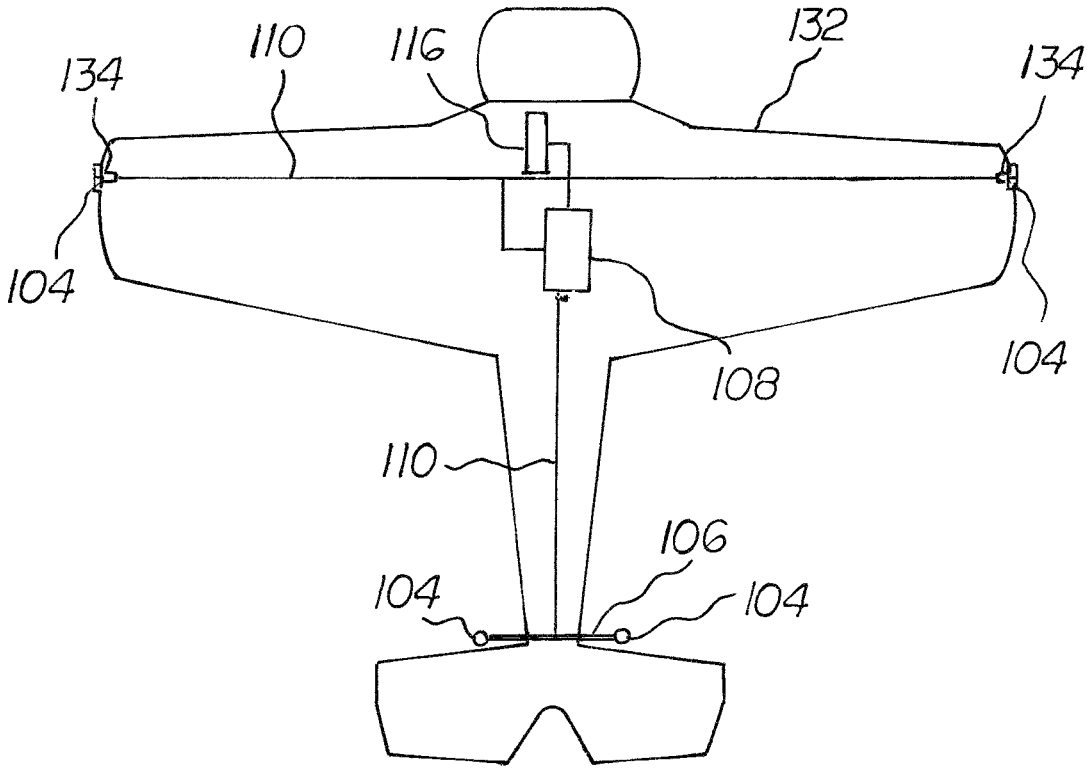
FIG. 7

MODEL AIRPLANE ILLUMINATION SYSTEM

I. FIELD

The present disclosure is generally related to a model airplane illumination system.

II. DESCRIPTION OF RELATED ART

Various forms of lights have been used with radio controlled ("RC") model airplanes so that the pilot can visually see the model airplane at night. For example, this includes attaching individual LEDs to the airplane so that the pilot can use the dots of light from the LEDs to direct the flight path of the model airplane. Similarly, arrays of LEDs or electroluminescent glow wire or chemical light sticks may be secured to the airplane to outline the airplane with light. However, the existing illumination systems do not illuminate the airplane itself to make the airplane visible. Instead the lights are directed outward away from the airplane and towards the pilot on the ground. Thus, the pilot is not visually viewing the RC airplane as it is flying but rather the pilot is flying the lights, which takes away from the enjoyment of flying a RC model airplane.

Accordingly, what is needed in the art is an illumination system that is configured to illuminate the RC model airplane surfaces so that the pilot can visually observe the airplane in low light conditions without impacting the aerodynamics of the airplane.

III. SUMMARY

In a particular embodiment, a model airplane illumination system is disclosed. The system includes a plurality of wingtip rods, a wingtip mount configured to secure at least one of the wingtip rods substantially perpendicular to each wingtip of a model airplane, and a plurality of light emitting diodes ("LED"), where at least one LED of the plurality of LEDs is secured to each end of the wingtip rods and configured to illuminate surfaces of the model airplane. In addition, the system includes a tail rod, a tail mount configured to secure the tail rod to a tail of the airplane and configured to illuminate the surfaces of the airplane, and at least one LED of the plurality of LEDs is secured to each end of the tail rod and configured to illuminate the tail and fuselage surfaces of the model airplane.

Other aspects, advantages, and features of the present disclosure will become apparent after review of the entire application, including the following sections: Brief Description of the Drawings, Detailed Description, and the Claims.

IV. BRIEF DESCRIPTION OF THE DRAWINGS

FIG. 4 is an alternative embodiment of the configuration of LEDs of the illumination system;

FIG. 5 is a detailed perspective view of the LED shown in FIG. 4;

FIG. 6 is an elevational schematic view of the illumination system installed on a radio controlled model airplane;

FIG. 7 is a top schematic view of the illumination system installed on the radio controlled airplane shown in FIG. 6.

V. DETAILED DESCRIPTION

Figure 1:
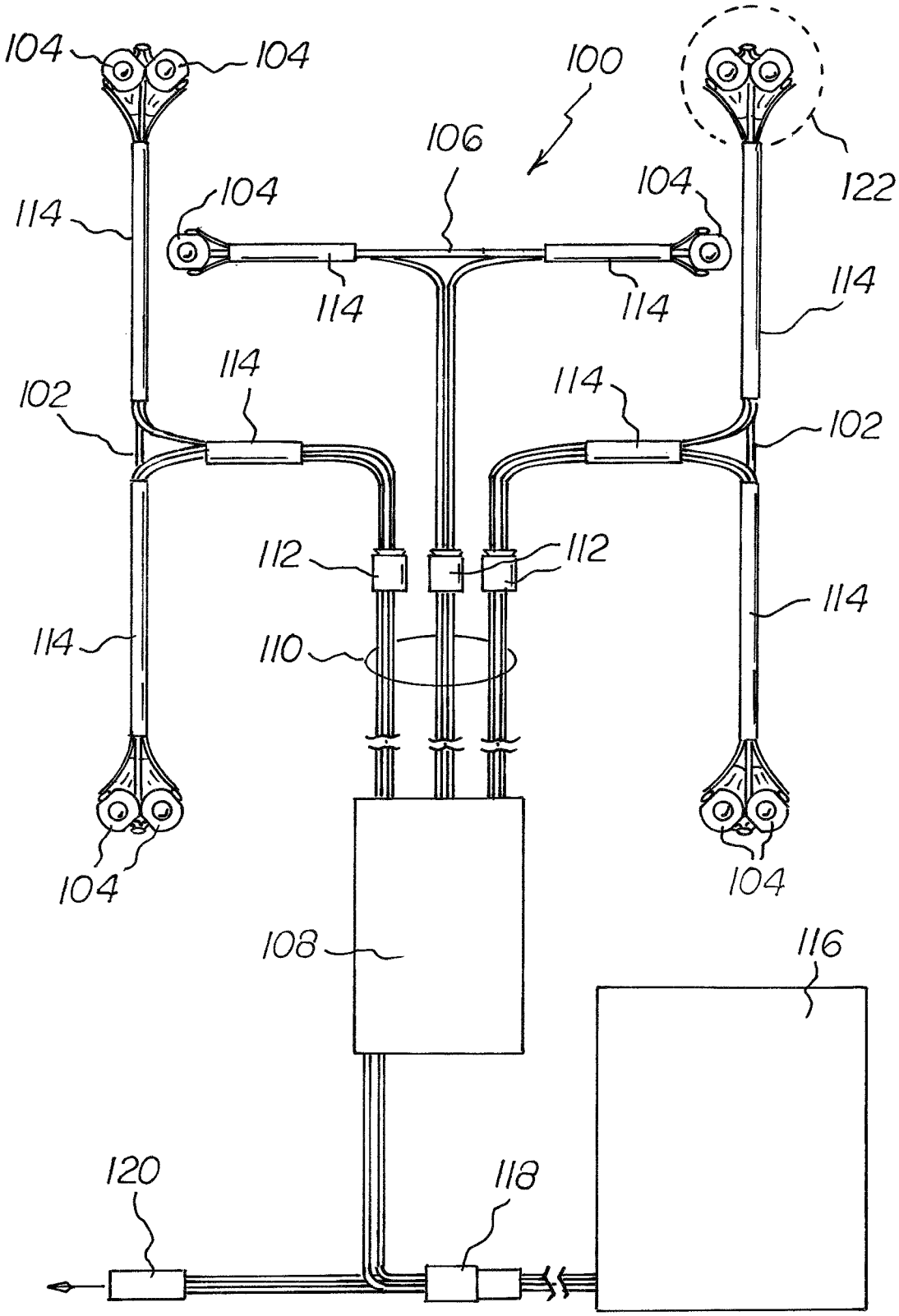
FIG. 1 is an elevational view of a particular embodiment of a model airplane illumination system.

A model airplane illumination system according to a particular embodiment is shown in FIG. 1, and generally designated 100. The illumination system 100 is adapted to be removably attachable to radio controlled model airplane to facilitate illumination of the airplane surfaces. The illumination system 100 includes a wingtip rod 102, and light emitting diodes ("LEDs") 104 secured proximate to each end of the wingtip rod 102. The wingtip rod 102 may be carbon fiber or any material that is relatively lightweight and substantially rigid. The wingtip rod 102 is relatively thin and may be as small as a few millimeters in diameter in a particular embodiment. The relatively thin wingtip rod 102 mitigates obscuration of the illuminated airplane when viewed in flight from the ground and provides a sturdy support with limited aerodynamic drag.

The LEDs 104 may be secured to the wingtip rod 102 using a substrate 130 such as epoxy, polyester film, fiberglass, or polyamide, for example. In a particular embodiment, the system 100 includes high optical output LEDs that exhibit a white light spectrum. Such LEDs typically are of two categories, RGB clusters or phosphor-based LEDs. RGB clusters comprise tight collections of LEDs that emit red, green, and blue light, respectively, in close proximity, thereby producing a composite white light output. Phosphor-based LEDs comprise LEDs of one color (mostly blue LEDs made of InGaN) coated with phosphors that emit different colors to form white light; the resultant LEDs are called phosphor-based white LEDs. LEDs of specific colors may also be used with the system 100. In addition, the LEDs 104 are mounted to the wingtip rod 102 with maximum air exposure so that adequate heat dissipation is achieved by convective air flow during airplane flight. The LEDs 104 may be ½ watt to 3 watt LEDs having at least a 140 viewing angle, for example.

In a particular embodiment, the illumination system 100 may include a pair of LEDs 104 attached proximate to each end of the wingtip rod 102. The wingtip rod 102 is adapted to be secured perpendicular to a wingtip of a model airplane using a wingtip mount or adhesive. The wingtip mount may be a clip that slides over the wingtip to removably secure the wingtip rod 102 in place.

The illumination system 100 also includes a tail rod 106, and light emitting diodes 104 secured proximate to each end of the tail rod 106. Similar to the wingtip rod 102, the tail rod 106 may be carbon fiber or any material that is relatively lightweight and substantially rigid and may be as small as a few millimeters in diameter in a particular embodiment. The relatively thin tail rod 106 mitigates obscuration of the illuminated airplane with limited aerodynamic drag. An LED 104 may be secured to each end of the tail rod 106 using a substrate 130 such as epoxy, polyester film, fiberglass, or polyamide, for example.

The wingtip rod 102 and tail rod 106 are configured to be removed from the model airplane when not needed, such as for daytime flying. The LEDs 104 on one end of the wingtip rod 102 are configured to primarily illuminate an upper surface of the wings of the model airplane, and LEDs 104 on the opposing end of the wingtip rod 102 illuminate a lower surface of the wings. The LEDs 104 on the tail rod 106 illuminate the tail section and fuselage of the airplane.

The wiring harness 110 and connections for a particular embodiment of the illumination system 100 is shown in FIG. 1. The LEDs 104 are configured to be attached to the right wing tip, left wing tip, and tail of the model airplane. Each of the LEDs is in electrical communication to the LED driver module 108 by the electrical wiring harness 110. The wiring harness 110 may be split into parallel connections using connector 120 that is in electrical communication with an electronic speed control ("ESC") and the driver module 121.

A power source 116 is connected to the LEDs using connectors 112 and the wiring harness 110. In a particular embodiment, the power source 116 is a rechargeable battery. For example, a rechargeable lithium polymer ("LiPo") battery. LiPo batteries exhibit relatively low weight and high power density. These batteries are usually composed of several identical secondary cells in parallel to increase the discharge current capability, and are often available in series "packs" to increase the total available voltage. Hence, they can be configured to match the needs of the lighting system as larger airplane models demand greater illumination power. The use of other varieties of rechargeable batteries may also be used with the system 100. Electricity is selectively supplied from the power source 116 to illuminate the LEDs 104 in response to certain predetermined conditions dependent upon the particular application. While FIG. 1 shows two LEDs 104 mounted to each end of the wingtip rod 102, it should be appreciated that any number of LEDs 104 may be implemented in a similar manner or a continuous length of LED light strip substrate may be mounted along the length of the wingtip rod 102 instead of individual LEDs 104.

The electrical connectors 112, 118 and 120 each include a first end that mates with a second end so that the LED driver 108 and power supply 116 can be easily connected and disconnected from the system 100. In particular, the wingtip rods 102 and tail rod 106 can be easily removed from the airplane when not needed by pulling the connectors 112 apart and the wiring harness 110, LED driver 108 and power supply 116 can remain installed in the airplane.

Figure 2:
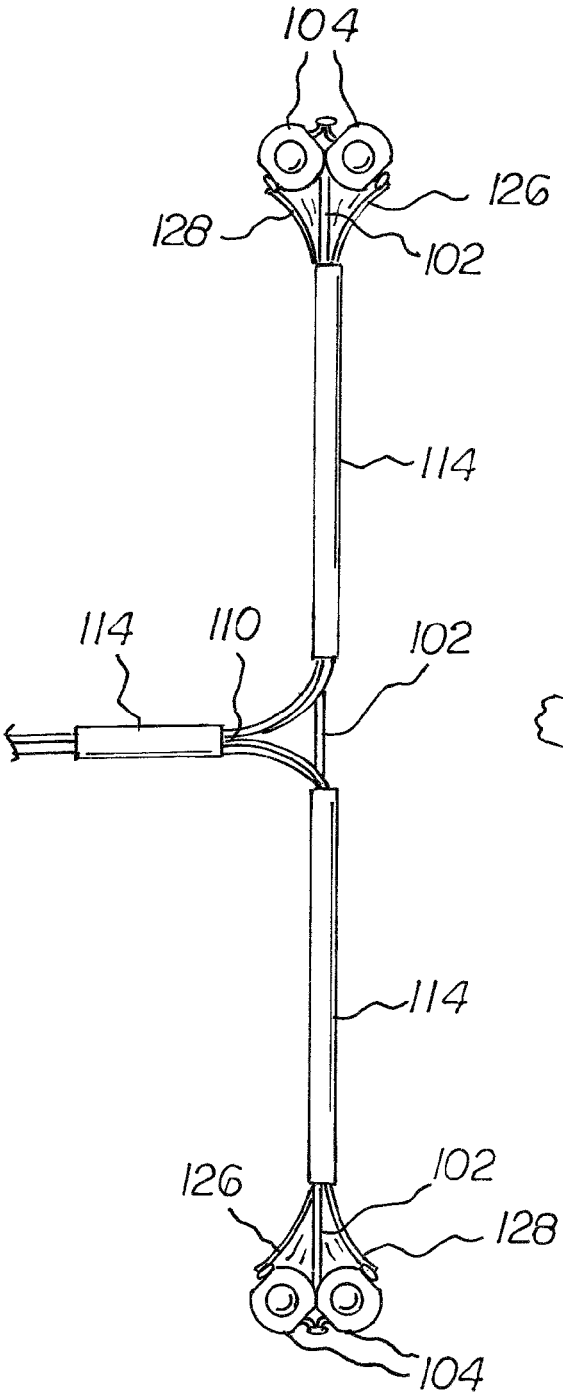
FIG. 2 is an elevational view of a wingtip rod and LEDs of the illumination system shown in FIG. 1.

FIG. 2 is an elevational view of the wingtip rod 102 and LEDs 104 of the illumination system shown in FIG. 1. Electrical wires 126, 128 are attached to each pair of LEDs 104 by solder connections or other electrical connections. Shrink wrap tubing or a sleeve 114 may be used to encapsulate the wires 126, 128 leading to the respective LED 104 and wingtip rod 102 in a snug and aerodynamically-favorable geometry. Accordingly, as the model airplane 132 is flying, the wingtip rods 102 and tail rod 106 do not interfere with the aerodynamic performance of the airplane 132 due to the rounded surfaces of the wingtip rod 102 and sleeves 114 encapsulating the wiring to the LEDs 104.

Figure 3:
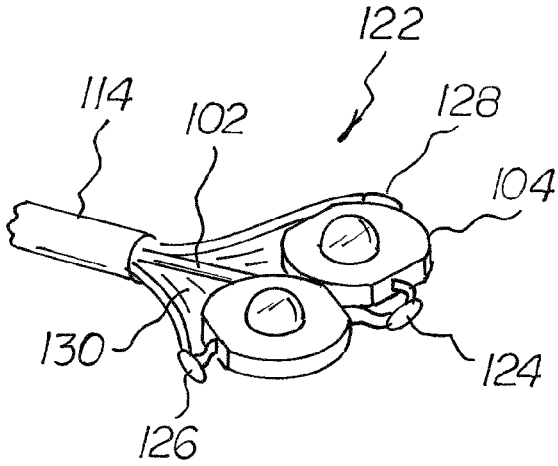
FIG. 3 is a detailed perspective view of the LEDs.

The LEDs 104 may be attached to the wingtip rod 102 by a substrate 130 such as an adhesive or cement, for example, as shown in FIG. 3, which is a partial view of one end of the wingtip rod assembly 122. Each LED 104 may be connected electrically in series through a solder connection 124. For example, a pair of LEDs 104 may be attached to each end of the wingtip rod 102 when greater illumination is typically desired for illumination of the wings and fuselage, however, for a tail rod 106 or for smaller scale model airplanes, a single LED 104 at each end of the wingtip rod 102 may be sufficient. The system 100 is adaptable to be used with any number of LEDs 104 for each wingtip rod 102 or tail rod 106.

Referring now to FIG. 3, a partial view of one end of a wingtip rod assembly 122 is shown where each LED 104 is connected electrically in series using a solder connection 124. Electrical wires 126, 128 are attached to each pair of LEDs 104 by solder connections or other electrical connections. Shrink wrap tubing or a sleeve 114 may be used to encapsulate the electrical wires 126, 128 and wingtip rod 102 in a snug aerodynamically-favorable geometry. Accordingly, as the model airplane 132 is flying, the wingtip rods 102 and tail rod 106 do not interfere with the aerodynamic performance of the airplane 132 due to the rounded surfaces of the wingtip rod 102 and sleeves 114 that encapsulate the wiring 126, 128 to the LEDs 104.

FIG. 4 depicts a tail rod 106 having one LED 104 at each end for illumination of areas requiring less light such at the tail of the model airplane. The single LED 104 tail rod 104 is similar to a wingtip rod 102 having a single LED 104 at each end of the wingtip rod 102. Accordingly, each end of the wingtip rod 102 or tail rod 106 may have differing numbers of LEDs 104 to address specific illumination needs. Similar to the wingtip rod 102 described above, the tail rod 102 and sleeves 114 have rounded surfaces to reduce drag on the model airplane 132 when flying. The surfaces of the tail rod 106 and wingtip rod 102 and respective sleeves 114 may be cylindrical or have a rounded leading edge with a camber or taper to a trailing edge similar to a wing. A partial view of one end of the tail rod assembly is shown in FIG. 5, where electrical wires 126, 128 are attached to each pair of LEDs 104 by solder connections or other electrical connections.

Referring now to FIG. 6, an elevational schematic of the illumination system 100 installed in the model airplane 132 is shown. The wingtip rod 102 is generally secured perpendicular to the wings of the airplane 132 so that an upper LED 104 illuminates an upper surface of the wing and a lower LED 104 illuminates a lower surface of the wing of the airplane 132. The LEDs 104 secured to the ends of the wingtip rod 102 are in electrical communication with the LED driver 108 and the power source 116. The LEDs 104 secured to the tail rod 106 are also in electrical communication with the LED driver 108 and the power source 116. In a particular embodiment, a small brushed electronic speed control ("ESC") 136 may be used with a wireless receiver (not shown) aboard the model airplane 132. For example, the ESC 136 may be in electrical communication with the on-board power source 116 and the LED driver module 108, which is connected to the wireless radio receiver aboard the model airplane 132 that is used to control the flight of the airplane 132. Accordingly, the ESC 136 can be used to remotely adjust the current to the LEDs 104 based on the control input. A proportional control channel having a slider control on the radio control transmitter may be used to allow the pilot to remotely adjust the brightness of the LEDs 104. The channel may also be used to turn the LEDs on and off.

A top schematic view of the illumination system 100 shown in FIG. 7 illustrates the location of the wingtip rods 102 at the model airplane wingtips. The tail rod 106 is secured proximate the tail section of the airplane 132. In a particular embodiment, the tail rod 106 is mounted perpendicular to the fuselage of the airplane 132. The power supply 116 is generally located within a centerline of the airplane 132 and is in electrical communication with the LED driver module 108. The wingtip mounts 134 are used to clip the wingtip rod 102 to the wingtip of the airplane 132. Accordingly, the wingtip mounts 134 allow the pilot to easily remove the wingtip rods 102 when not needed. The wingtip rod mounts 134 may be spring loaded clips, friction fit, press fit, tension, or any similar mechanical means. The wingtip rods 102 may also be taped, glued, or cemented to the wingtip of the airplane 132. Similarly, the tail rod mount 138 may easily be installed and removed using spring loaded clips, friction fit, press fit, tension, or any similar mechanical means. The tail rod 106 may also be taped, glued, or cemented to the airplane 132 similar to the wingtip rod 102.

Figure 8:
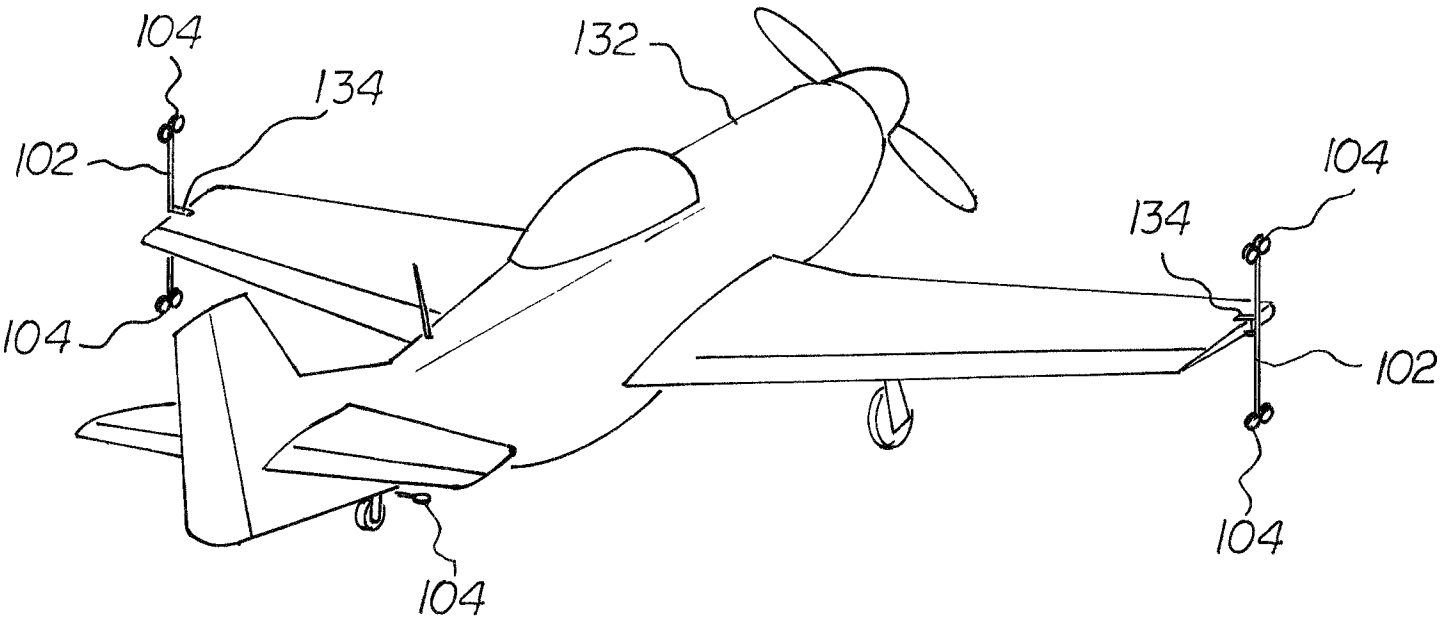
FIG. 8 is a perspective view of the illumination system installed on the radio controlled airplane.

The illumination system 100 is shown installed on a model airplane in FIG. 8. The wingtip rods 102 are installed perpendicular to the wings of the airplane 132. The LEDs 104 are configured to illuminate both the upper surface and lower surfaces of the wings. Accordingly, as the pilot is operating the airplane 132 from the ground, the airplane 132 is illuminated and visible at all times even when the airplane 132 may be rotating while performing aerobatics. The tail rod 104 is secured perpendicular to the airplane fuselage and in front of the tail section in FIG. 8. However, the tail rod 106 may be secured behind the tail section or on the upper surface of the fuselage proximate the tail section or any other configuration that is desired by the pilot. The wingtip mounts 134 are clipped to the wingtips and secure the wingtip rods 102 to the wings of the airplane 132. In another particular embodiment, the wingtip rods 102 may be rotated about the wingtip mounts 134 and secured to any angle relative to the wings of the airplane rather than perpendicular to the wings.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A model airplane illumination system, the system comprising:

at least one wingtip rod;

a wingtip mount configured to secure at least one of the wingtip rods substantially perpendicular to a wingtip of a model airplane; and a plurality of light emitting diodes ("LED"), wherein at least one LED of the plurality of LEDs is secured to each end of the wingtip rod and configured to illuminate surfaces of the model airplane.

2. The illumination system of claim 1, further comprising:

a tail rod;

a tail mount configured to secure the tail rod to a tail of the airplane and configured to illuminate the surfaces of the airplane; and at least one light emitting diode ("LED") of the plurality of LEDs is secured to each end of the tail rod and configured to illuminate the surfaces of the model airplane.

3. The illumination system of claim 2, further comprising an LED driver in communication with the plurality of LEDS.

4. The illumination system of claim 3, wherein the wingtip rod is cylindrical in shape to reduce aerodynamic drag.

5. The illumination system of claim 4, further comprising a wiring harness in communication with a power source and the LED driver.

6. The illumination system of claim 5, wherein the plurality of LEDs are each 3 watt LEDs having at least a 140 viewing angle.

7. The illumination system of claim 6, wherein the power source is a direct current ("DC") power supply.

8. The illumination system of claim 7, wherein the wingtip rod is comprised of carbon fiber.

9. The illumination system of claim 8, further comprising a sleeve encapsulating wiring alongside the wingtip rod that leads to the LEDs.

10. The illumination system of claim 9, wherein the illumination system is removable from the model airplane.

11. The illumination system of claim 10, wherein two LEDs of the plurality LEDs are disposed on each end of the wingtip rod.

12. The illumination system of claim 11, wherein the LEDs are removable from the wiring harness using electrical connectors.

13. A model airplane illumination system, the system comprising:

a carbon fiber wingtip rod configured to be secured substantially perpendicular to a wingtip of a model airplane;

a plurality of light emitting diodes ("LED"), wherein at least one LED is secured to each end of the wingtip rod and configured to illuminate surfaces of the model airplane; and a carbon fiber tail rod configured to be secures the tail rod to a tail of the airplane and configured to illuminate the surfaces of the airplane; and at least one light emitting diode ("LED") of the plurality of LEDs is secured to each end of the tail rod and configured to illuminate the surfaces of the model airplane.

14. The illumination system of claim 13, further comprising an LED driver in communication with the plurality of LEDS.

15. The illumination system of claim 14, wherein the wingtip rod is cylindrical in shape to reduce aerodynamic drag.

16. The illumination system of claim 15, further comprising a wiring harness in communication with a power source and the LED driver.

17. The illumination system of claim 16, wherein the power source is a direct current ("DC") power supply.

18. The illumination system of claim 17, further comprising a plurality of sleeves to encapsulate wiring alongside the wingtip rod and the tail rod that leads to the respective LEDs.

19. The illumination system of claim 18, wherein the illumination system is removable from the model airplane.

20. A model airplane illumination system, the system comprising:

a carbon fiber wingtip rod configured to be secured substantially perpendicular to a wingtip of a model airplane to illuminate surfaces of the model airplane; and a carbon fiber tail rod configured to be secured proximate a tail of the model airplane to illuminate the surfaces of the model airplane.

* * * * *